United States Patent [19]

Kelley

[11] Patent Number: 4,910,815

[45] Date of Patent: Mar. 27, 1990

[54] SANITARY TOILET SEAT DEVICE

[76] Inventor: Andre G. Kelley, 5709 Rossburn Ct., Virginia Beach, Va. 23455

[21] Appl. No.: 255,943

[22] Filed: Oct. 11, 1988

[51] Int. Cl.[4] ..... A47K 17/02

[52] U.S. Cl. ..... 4/661; 4/DIG. 5

[58] Field of Search ..... 4/144.2, 144.3, 144.4, 4/661, DIG. 5

[56] References Cited

U.S. PATENT DOCUMENTS

| | | | |
|---|---|---|---|
| 2,600,478 | 6/1952 | Butcher | 4/144.4 X |
| 3,205,509 | 9/1965 | Rose | 4/DIG. 5 X |
| 3,625,654 | 12/1971 | Duyne | 4/661 X |
| 4,198,716 | 4/1980 | Hollyday | 4/254 |
| 4,437,430 | 3/1984 | DeBardeleben | 4/661 |
| 4,612,676 | 9/1986 | Whitman | 4/DIG. 5 X |

*Primary Examiner*—Charles E. Phillips

*Attorney, Agent, or Firm*—Leon Gilden

[57] ABSTRACT

A sanitary toilet seat device is set forth for use as an adjunct in combination with a conventional toilet seat or in use with other toilet seat covers wherein the instant invention includes a concave arcuate member for resilient securement to a toilet seat and further includes an adhesive strip for selective adherement to said seat or adherement to additional toilet seat covers. The device includes a cup-shaped member secured to the arcuate member for positioning of the male penal member to avoid undesirable contact with the interior portions of the commode.

1 Claim, 1 Drawing Sheet

SANITARY TOILET SEAT DEVICE

BACKGROUND OF THE INVENTION

1. Field of the Invention

The instant invention is directed to sanitary devices and more particularly pertains to a new and improved sanitary toilet seat device that is selectively securable and/or adherable to a toilet seat cover to prevent undesirable contact with potential unsanitary surfaces of the commode.

2. Description of the Prior Art

The use of sanitary devices in conjunction with commodes and the like is well known in the prior art. Historically these devices have been of relatively elaborate and expansive organizations to completely cover an existing toilet seat and furthermore be of generic application to male and female users. For example, U.S. Pat. No. 4,050,105 to Marceaux sets forth a cover for positioning over the top surface of a toilet seat of an enhanced dimension to completely cover said seat and foldable over the outside edges thereof to maintain the seat in a predetermined position. This is opposed to the instant invention that may utilize existing generic toilet seat covers for application and of particular use by male individuals.

U.S. Pat. No. 2,312,589 to Reeves sets forth an overlying toilet seat protector formed of a relatively rigid material for clamping engagement with the entire top surface of an existing toilet seat.

U.S. Pat. No. 1,776,333 to Oates sets forth a toilet seat cover formed with downwardly depending tang that may ostensibly be utilized by male patrons.

U.S. Pat. No. 1,225,673 to Nichols sets forth a toilet seat cover formed with a downwardly directed shield depending from the toilet seat cover.

U.S. Pat. No. 2,730,047 to Williams sets forth a toilet seat cover of rectangular configuration formed with a spoon-shaped cutout portion for use by individuals.

U.S. Pat. No. Des. 174,213 sets forth a toilet seat cover for frictional securement to an existing toilet seat.

U.S. Pat. No. 1,411,085 to Grobe sets forth a toilet seat cover formed with a downwardly directing shield toilet seat cover of configuration typical of the prior art.

As such, it may be appreciated that there is a continuing need for a new and improved sanitary toilet seat device which addresses both the problem of sanitary protection of male users and ease of application, and in this respect the present invention substantially fulfills this need.

SUMMARY OF THE INVENTION

In view of the foregoing disadvantages inherent in the known types of sanitary toilet seat devices now present in the prior art, the present invention provides a sanitary toilet seat device wherein the same may be selectively securable to a toilet seat or alternatively to an additional toilet seat protective cover. As such, the general purpose of the present invention, which will be described subsequently in greater detail, is to provide a new and improved sanitary toilet seat device which has all the advantages of the prior art toilet seat covers and none of the disadvantages.

To attain this, the present invention comprises an arcuate convex toilet seat securement rim defining an arc of approximately 20 to 45 degrees for securement to a forwardmost portion of a conventional toilet seat. The rim has formed projecting downwardly and medially of an interior rim thereof and a cup-shaped member for support of positioning of a male penile member for avoidance of contact of such member with various surfaces of an associated commode. The cup-shaped member may be alternatively formed of a cylindrical configuration with an opening at an upper portion thereof for acceptance of the male penile member with a lowermost portion of reduced opening relative to the upper opening to enable the male user of the device to effect normal fluid discharge in use of the commode. The concave underside portion of the arcuate member is provided with an adhesive strip thereto to enable securement of the apparatus to an associated toilet seat or toilet seat cover. Further, the arcuate member may be formed of resilient plastic-like material for clamping securement to a toilet seat.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sanitary toilet seat device which has all the advantages of the prior art sanitary toilet seat device and none of the disadvantages.

It is another object of the present invention to provide a new and improved sanitary toilet seat device which may be easily and efficiently manufactured and marketed.

It is a further object of the present invention to provide a new and improved sanitary toilet seat device which is of a durable and reliable construction.

An even further object of the present invention is to provide a new and improved sanitary toilet seat device which is susceptible of a low cost of manufacture with regard to both materials and labor, and which accordingly is then susceptible of low prices of sale to the consuming public, thereby making such sanitary toilet seat device economically available to the buying public.

Still yet another object of the present invention is to provide a new and improved sanitary toilet seat device which provides in the apparatuses and methods of the prior art some of the advantages thereof, while simultaneously overcoming some of the disadvantages normally associated therewith.

Still another object of the present invention is to provide a new and improved sanitary toilet seat device wherein the same may be selectively secured to a toilet seat or toilet seat cover for acceptance of a male penile member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
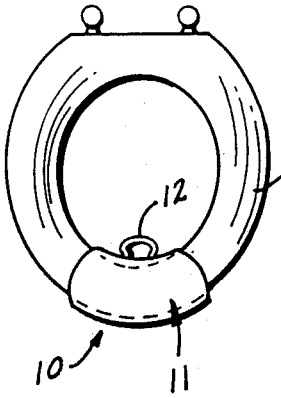
FIG. 1 is a top orthographic view of the instant invention.

With reference now to the drawings, and in particular to FIGS. 1 to 6 thereof, a new and improved sanitary toilet seat device embodying the principles and concepts of the present invention and generally designated by the reference numerals 10 and **10*a*** will be described.

Figure 2:
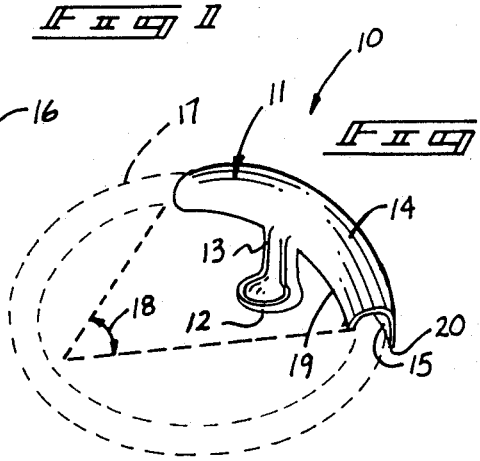
FIG. 2 is an isometric illustration of the instant invention.
Figure 3:
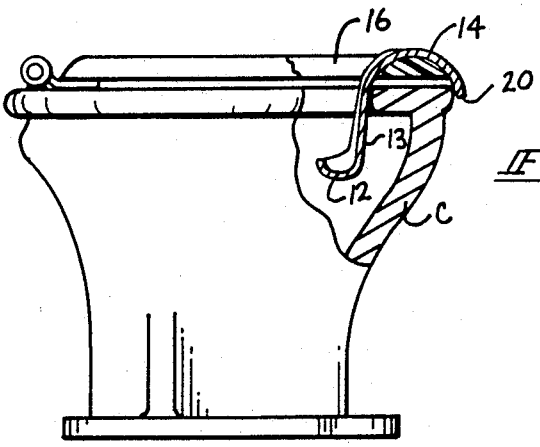
FIG. 3 is an orthographic cross-sectional view of the instant invention secured to a typical toilet seat.

More specifically, it will be noted that the sanitary toilet seat device 10 essentially comprises an arcuate toilet seat securement member 11. The securement member 11 is formed with a convex exterior surface 14 and a concave interior surface 15, as illustrated in FIG. 2 for example. A vertically disposed trough 13 is integrally secured to a medial portion of the interior edge 19 of the securement member 11. Integrally formed to a lower terminal end of said trough 13 is a horizontally disposed cup-shaped member 12 for acceptance of a male penile member to space said member from surfaces of the commode "C". The securement member 11 is of an arc defined by angle 18 of 20 to 45 degrees to enable securement of the member to a forwardmost portion of the toilet seat 16. The securement member 11 is preferably formed of a resilient memory retentent plastic-like material for a snap-fit securement to the associated seat 16. The exterior edge 20 of the securement member 11 is at a lowermost orientation relative to the interior edge 19 to enhance securement to the toilet seat 16. Alternatively, the toilet seat device 10 may be secured to a toilet seat cover 17, as illustrated in phantom in FIG. 2, to afford maximum protection to a user of an associated commode.

Figure 4:
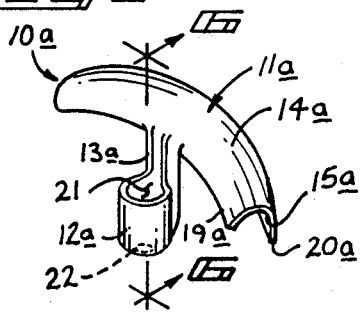
FIG. 4 is an isometric illustration of a further embodiment of the instant invention.

Reference to FIG. 4 illustrates a modified toilet seat device **10*a* formed with a similar arcuate seat securement member 11*a*. The dimensions of the toilet seat securement member 11 are equivalent to that of that set forth in FIGS. 1 and 2 for example, with the notable exception being the cylindrical member 12*a* secured to the associated vertical trough 13*a*. The cylindrical member 12*a* is defined by an upper cylindrical opening 21 equal to the diameter of the cylindrical member 12*a* and further including a lower circular opening 22 of a greatly reduced diametrical dimension to that of circular opening 21 to enable acceptance of a male penile member within the cylindrical member 12*a* and enable fluid discharge through the opening 22** in a conventional manner.

Figure 6:
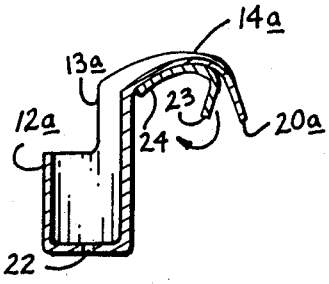
FIG. 6 is an orthographic view taken along the lines 6—6 of FIG. 4 in the direction indicated by the arrows.

FIG. 6 illustrates the use of an adhesive 23 with an overlying removable flexible strip 24 thereover. The strip enables the selective and cooperative use of adhesive as well as the clamping securement of the securement member 11 or **11*a* to an associated toilet seat 16 or toilet seat cover 17**.

Figure 5:
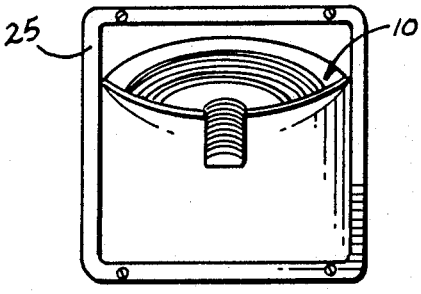
FIG. 5 is an orthographic illustration of a nested stack of the instant invention for dispensing thereof.

FIG. 5 illustrates the use of a dispenser 25 provided with a nested stack of sanitary toilet seat devices 10 for selective removal therefrom. It should be noted that the use of the adhesive 23 and removable strip 24 are used by either the sanitary toilet seat device 10 or **10*a* illustrated per FIGS. 2 and 6**, for example.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sanitary toilet seat device for use in combination with a toilet seat comprising, an arcuate toilet seat securement means for securement to a forwardmost portion of said toilet seat, and a vertically disposed member integrally secured to an interior edge of said securement means, and a cup-shaped means integrally secured to a lowermost portion of said vertically disposed member for acceptance of a male penile member, and wherein said toilet seat securement means includes a convex exterior surface and an underlying concave interior surface, and wherein said vertically disposed member is secured to said interior edge medially of said interior edge, and wherein an exterior edge of said toilet seat securement means is equally spaced from said interior edge and vertically disposed along a line underlying said interior edge, and wherein said concave interior surface is formed with an adhesive strip means thereon for securement to said toilet seat or alternatively to a toilet seat cover, and a flexible strip is selectively removable from said adhesive strip for exposing said adhesive strip, and wherein said arcuate toilet seat securement means is formed of a memory retentent resilient material for resiliently grasping said toilet seat, and wherein said cup-shaped means is of a vertically disposed cylindrical configuration and wherein said cup-shaped means is formed with a circular upper opening of equal diametrical dimension to said cylindrical configuration, and further including a lower opening of reduced diametrical dimension relative to said upper opening, and wherein said arcuate toilet seat securement means is of an arc between 20 and 45 degrees.

* * * * *